US010782628B2

(12) United States Patent
Mizutani

(10) Patent No.: US 10,782,628 B2
(45) Date of Patent: Sep. 22, 2020

(54) OPTICAL SCANNER AND IMAGE FORMING APPARATUS INCLUDING OPTICAL SCANNER

(71) Applicant: KYOCERA Document Solutions Inc., Osaka-shi (JP)

(72) Inventor: Hideji Mizutani, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/526,339

(22) Filed: Jul. 30, 2019

(65) Prior Publication Data

US 2020/0041924 A1 Feb. 6, 2020

(30) Foreign Application Priority Data

Aug. 1, 2018 (JP) ..... 2018-144957

(51) Int. Cl.
*G03G 15/04* (2006.01)
*G03G 15/043* (2006.01)

(52) U.S. Cl.
CPC ..... *G03G 15/043* (2013.01)

(58) Field of Classification Search
CPC ..... G03G 15/043; G03G 2215/0404; G03G 2215/0407; G02B 26/10
See application file for complete search history.

(56) References Cited

U.S. PATENT DOCUMENTS

2015/0338769 A1* 11/2015 Koga ..... G03G 15/043 347/118
2016/0349660 A1* 12/2016 Hirano ..... G03G 15/043
2018/0181021 A1* 6/2018 Mizutani ..... G03G 15/043

FOREIGN PATENT DOCUMENTS

JP 2017-064992 4/2017

* cited by examiner

*Primary Examiner* — Sophia S Chen
(74) *Attorney, Agent, or Firm* — Gerald E. Hespos; Michael J. Porco; Matthew T. Hespos

(57) ABSTRACT

An optical scanner includes a multi beam light source, a scanning optical system, and a controller. The controller specifies selected beams, and changes light quantities of the respective selected beams at the same change timing based on the same profile data at respective positions in the main scanning direction which are fixedly determined as light quantity change positions. When the position of a center region in an arrangement width of the plurality of selected beams is moved in the main scanning direction in response to a selected mode of the beams, in the profile data, the controller derives a shift light quantity at a position shifted in the main scanning direction by an amount corresponding to the movement of the position of the center region, and the light quantity is modified so that the shift light quantity is used at the light quantity change position.

7 Claims, 15 Drawing Sheets

FIG.14

<PROFILE DATA>

| BLOCK NUMBER | MAIN SCANNING POSITION | CORRECTION LIGHT QUANTITY |
|---|---|---|
| 1 | −150 | 1.1110 |
| 2 | −140 | 1.0870 |
| 3 | −130 | 1.0870 |
| 4 | −120 | 1.0990 |
| 5 | −110 | 1.0990 |
| 6 | −100 | 1.0870 |
| 7 | −90 | 1.0750 |
| 8 | −80 | 1.0525 |
| 9 | −70 | 1.0210 |
| 10 | −60 | 1.0105 |
| 11 | −50 | 1.0105 |
| 12 | −40 | 1.0420 |
| 13 | −30 | 1.0105 |
| 14 | −20 | 0.9805 |
| 15 | −10 | 0.9895 |
| 16 | 0 | 1.0000 |
| 17 | 10 | 1.0105 |
| 18 | 20 | 1.0105 |
| 19 | 30 | 1.0105 |
| 20 | 40 | 1.0105 |
| 21 | 50 | 1.0210 |
| 22 | 60 | 1.0315 |
| 23 | 70 | 1.0525 |
| 24 | 80 | 1.0750 |
| 25 | 90 | 1.0525 |
| 26 | 100 | 1.0420 |
| 27 | 110 | 1.0525 |
| 28 | 120 | 1.0645 |
| 29 | 130 | 1.0645 |
| 30 | 140 | 1.1110 |
| 31 | 150 | 1.1230 |

<MODIFIED PROFILE DATA>

| BLOCK NUMBER | MODIFIED CORRECTION LIGHT QUANTITY | CENTER MAIN SCANNING POSITION IN LD1 TO LD4 |
|---|---|---|
| 1 | 1.111000 | −151 |
| 2 | 1.089400 | −141 |
| 3 | 1.087000 | −131 |
| 4 | 1.097800 | −121 |
| 5 | 1.099000 | −111 |
| 6 | 1.088200 | −101 |
| 7 | 1.076200 | −91 |
| 8 | 1.054750 | −81 |
| 9 | 1.024150 | −71 |
| 10 | 1.011550 | −61 |
| 11 | 1.010500 | −51 |
| 12 | 1.038850 | −41 |
| 13 | 1.013650 | −31 |
| 14 | 0.983500 | −21 |
| 15 | 0.988600 | −11 |
| 16 | 0.998950 | −1 |
| 17 | 1.009450 | 9 |
| 18 | 1.010500 | 19 |
| 19 | 1.010500 | 29 |
| 20 | 1.010500 | 39 |
| 21 | 1.019950 | 49 |
| 22 | 1.030450 | 59 |
| 23 | 1.050400 | 69 |
| 24 | 1.072750 | 79 |
| 25 | 1.054750 | 89 |
| 26 | 1.043050 | 99 |
| 27 | 1.051450 | 109 |
| 28 | 1.063300 | 119 |
| 29 | 1.064500 | 129 |
| 30 | 1.106350 | 139 |
| 31 | 1.121800 | 149 |

OPTICAL SCANNER AND IMAGE FORMING APPARATUS INCLUDING OPTICAL SCANNER

INCORPORATION BY REFERENCE

The present application is filed based on Japanese patent application 2018-144957 filed to Japanese Patent Office on Aug. 1, 2018, and the contents of the Japanese patent application 2018-144957 are incorporated herein by reference.

BACKGROUND

Field of the Invention

This disclosure relates to an optical scanner which scans a surface to be scanned using a multi beam type light source, and an image forming apparatus including the optical scanner.

Related Art

An image forming apparatus such as a laser printer or a copier includes an optical scanner which forms an electrostatic latent image by scanning a peripheral surface (a surface to be scanned) of a photosensitive drum. The optical scanner includes: a light source for emitting a beam which is a light beam for scanning; a polygon mirror having a plurality of mirror surfaces which deflects the beam; and an imaging optical system which forms an image on the surface to be scanned using the deflected beam (scanning beam). There may be a case where a multi beam type light source which generates a plurality of beams is used as the above-mentioned light source. The multi beam light source includes a plurality of laser diodes which are disposed in a spaced apart manner from each other at a predetermined distance in a main scanning direction and a sub scanning direction, and generate beams respectively.

In the imaging optical system, in the case where a latent image is formed by scanning the surface to be scanned by the beam and the latent image is developed, there is a possibility that concentration irregularities occur in the main scanning direction due to various factors. A unit for correcting a light quantity of the beam is adopted for cancelling such concentration irregularities. Specifically, cancellation of concentration irregularities is performed using profile data where respective positions in the main scanning direction determined based on a measurement result of concentration irregularities on the surface to be scanned and a correction light quantity of the beam are associated with each other, and a beam light quantity is increased or decreased based on the correction light quantity at the time of scanning at respective positions in the main scanning direction. In many cases, the main scanning positions where the correction of a light quantity is performed are fixedly set in advance. In such an imaging optical system which adopts the multi beam light source, between a plurality of beams, the main scanning positions at which beams are irradiated to the surface to be scanned at same timing differ from each other. Accordingly, there is provided a technique which makes correction timings differ from each other between the beams so that light quantities of the respective beams are respectively corrected at the target main scanning positions.

SUMMARY

According to one aspect of this disclosure, an optical scanner includes a multi beam light source, a scanning optical system and a controller. The multi beam light source can generate a plurality of beams arranged in a main scanning direction. The scanning optical system scans a predetermined surface to be scanned in the main scanning direction by the plurality of beams. The controller controls turn-on operations and light quantities of the plurality of respective beams. The controller specifies a plurality of beams used for scanning among the plurality of beams as selected beams, and changes light quantities of the respective selected beams at the same change timing based on the same profile data at respective positions in the main scanning direction which are fixedly determined in advance as light quantity change positions. When the position of a center region in an arrangement width of the plurality of selected beams in the main scanning direction is moved in the main scanning direction in response to a selected mode of the beams, in the profile data, the controller derives a shift light quantity at a position shifted in the main scanning direction by an amount corresponding to the movement of the position of the center region, and the light quantity is modified so that the shift light quantity is applied at the light quantity change position.

According to another aspect of this disclosure, there is provided an image forming apparatus which includes: an image carrier which carries an electrostatic latent image; and the optical scanner described above which radiates a light beam to a peripheral surface of the image carrier which forms the surface to be scanned.

BRIEF DESCRIPTION OF THE DRAWINGS

FIG. 14 is a view in the form of a table showing a specific example of a shift light quantity;

DETAILED DESCRIPTION

Figure 1:
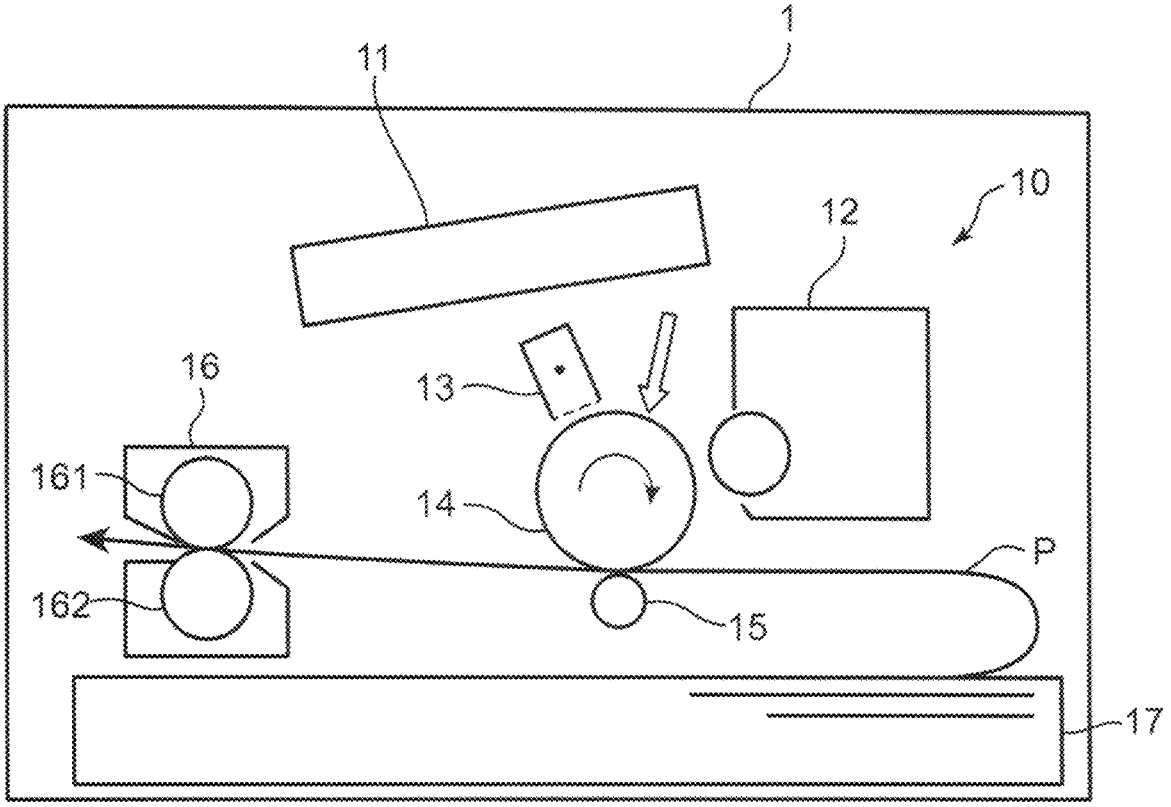
FIG. 1 is a schematic cross-sectional view of an image forming apparatus according to an embodiment of this disclosure.

Hereinafter, an optical scanner according to one embodiment of this disclosure is described with reference to drawings. FIG. 1 is a cross-sectional view schematically showing the configuration of an image forming apparatus 1 on which the optical scanner 11 according to the embodiment of this disclosure is mounted. In this embodiment, a printer is exemplified as the image forming apparatus. However, this disclosure is also applicable to a copier, a facsimile, and a multifunction printer having various functions. The image forming apparatus 1 includes an image forming unit 10, a fixing unit 16, and a sheet feed cassette 17. The image forming unit 10 includes an optical scanner 11, a developer 12, a charger 13, a photosensitive drum 14 (image carrier), and a transfer roller 15.

The photosensitive drum 14 is a circular cylindrical member, and an electrostatic latent image and a toner image are carried on a peripheral surface of the photosensitive drum 14. The photosensitive drum 14 is rotated in a clockwise direction shown in FIG. 1 by receiving a drive force from a motor not shown in the drawing. The charger 13 charges the surface of the photosensitive drum 14 substantially uniformly.

The optical scanner 11 is an optical scanner adopting a multi beam method. The optical scanner 11 includes a laser light source adopting a multi beam method, a polygon mirror, and a scanning optical system having a scanning lens, an optical element and the like. The optical scanner 11 forms an electrostatic latent image of image data by irradiating a laser beam modulated corresponding to image data on the peripheral surface of the photosensitive drum 14 substantially uniformly charged by the charger 13 as a surface to be scanned. The optical scanner 11 is described in detail later.

The developer 12 forms a toner image by supplying toner to the peripheral surface of the photosensitive drum 14 on which the electrostatic latent image is formed. The developer 12 includes a developer roller which carries toner, and a screw which stirs and conveys toner. The toner image formed on the photosensitive drum 14 is transferred to a sheet which is fed from the sheet feed cassette 17 and is conveyed along a conveyance path P. The developer 12 is replenished with toner from a toner container not shown in the drawing.

The transfer roller 15 is disposed below the photosensitive drum 14 in an opposedly facing manner, and a transfer nip portion is formed by both parts. The transfer roller 15 is formed using a rubber material having electric conductivity or the like, and a transfer bias is applied to the transfer roller 15. Accordingly, the toner image formed on the photosensitive drum 14 is transferred to the sheet.

The fixing unit 16 includes: a fixing roller 161 in which a heater is incorporated; and a pressure applying roller 162 which is disposed at a position opposedly facing the fixing roller 161. The fixing unit 16 fixes the toner image to the sheet by conveying the sheet to which the toner image is transferred while heating the sheet and applying a pressure to the sheet.

An image forming operation of the image forming apparatus 1 is briefly described. Firstly, the surface of the photosensitive drum 14 is charged approximately uniformly by the charger 13. The peripheral surface of the charged photosensitive drum 14 is exposed by the optical scanner 11 so that an electrostatic latent image of an image to be formed on a sheet is formed on the surface of the photosensitive drum 14. With the supply of toner to the peripheral surface of the photosensitive drum 14 from the developer 12, the electrostatic latent image appears as a toner image. On the other hand, a sheet is fed to the conveyance path P from the sheet feed cassette 17. When the sheet passes a nip portion formed between the transfer roller 15 and the photosensitive drum 14, the toner image is transferred to the sheet. The sheet is conveyed to the fixing unit 16 after such a transfer operation, and the toner image is fixed to the sheet.

[Configuration of Optical Scanner]

Figure 2:
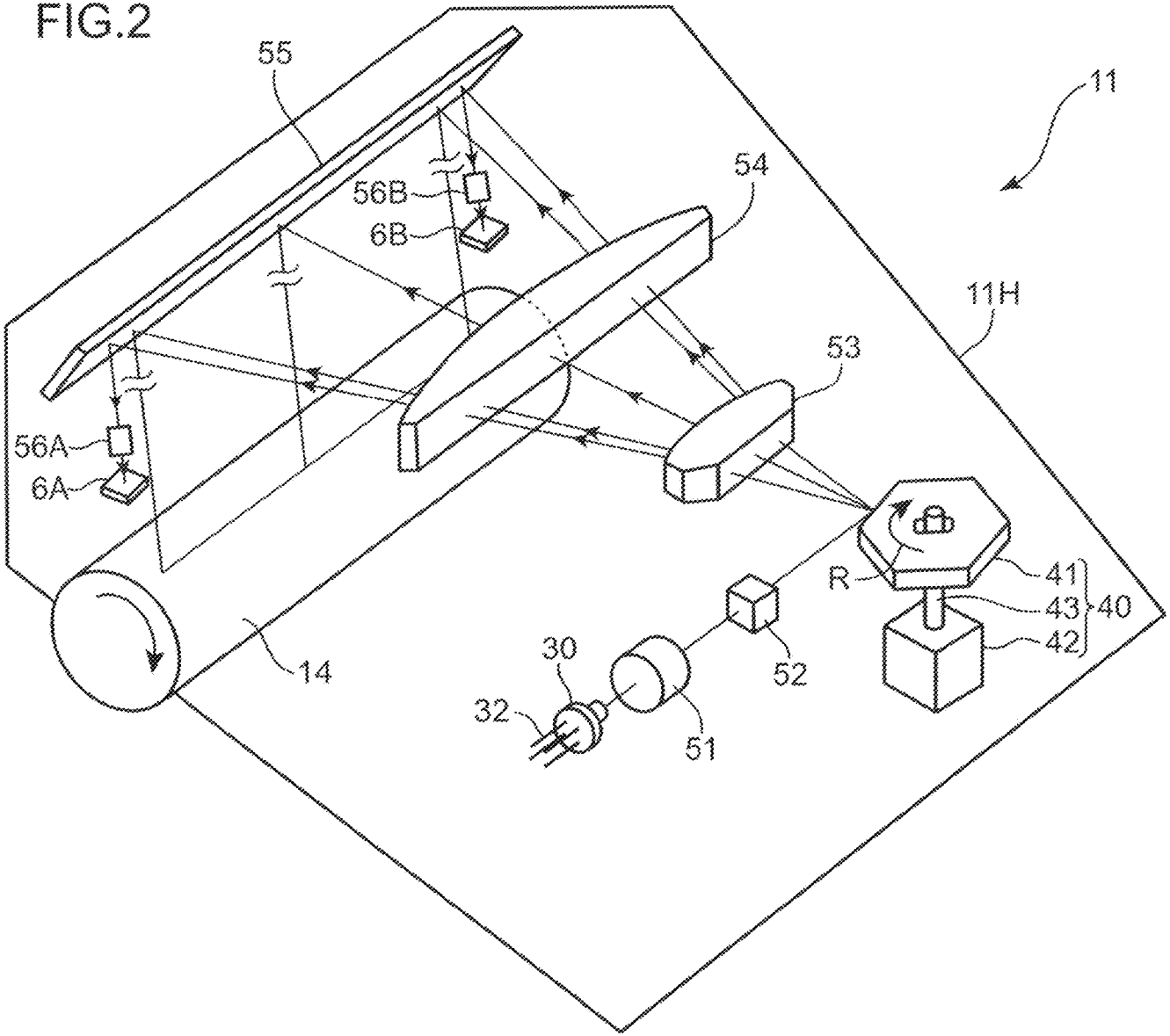
FIG. 2 is a perspective view schematically showing the internal configuration of an optical scanner according to the embodiment of this disclosure.

FIG. 2 is a perspective view schematically showing the internal configuration of the optical scanner 11. The optical scanner 11 includes: a housing 11H; a laser light source unit 30 (multi beam light source) housed in the housing 11H; and a scanning optical system which scans a surface to be scanned in a main scanning direction by a beam which the laser light source unit 30 emits. In this embodiment, the scanning optical system includes: a polygon unit 40 which deflects the beam and makes the beam scan the surface to be scanned; an imaging optical system which forms an image by converging the deflected beam to the peripheral surface of the photosensitive drum 14; and first, second beam detect (BD) sensors 6A, 6B. The imaging optical system includes a collimator lens 51, a cylindrical lens 52, a first scanning lens 53, a second scanning lens 54, a mirror 55, and first, second converging lenses 56A, 56B.

Figure 3:
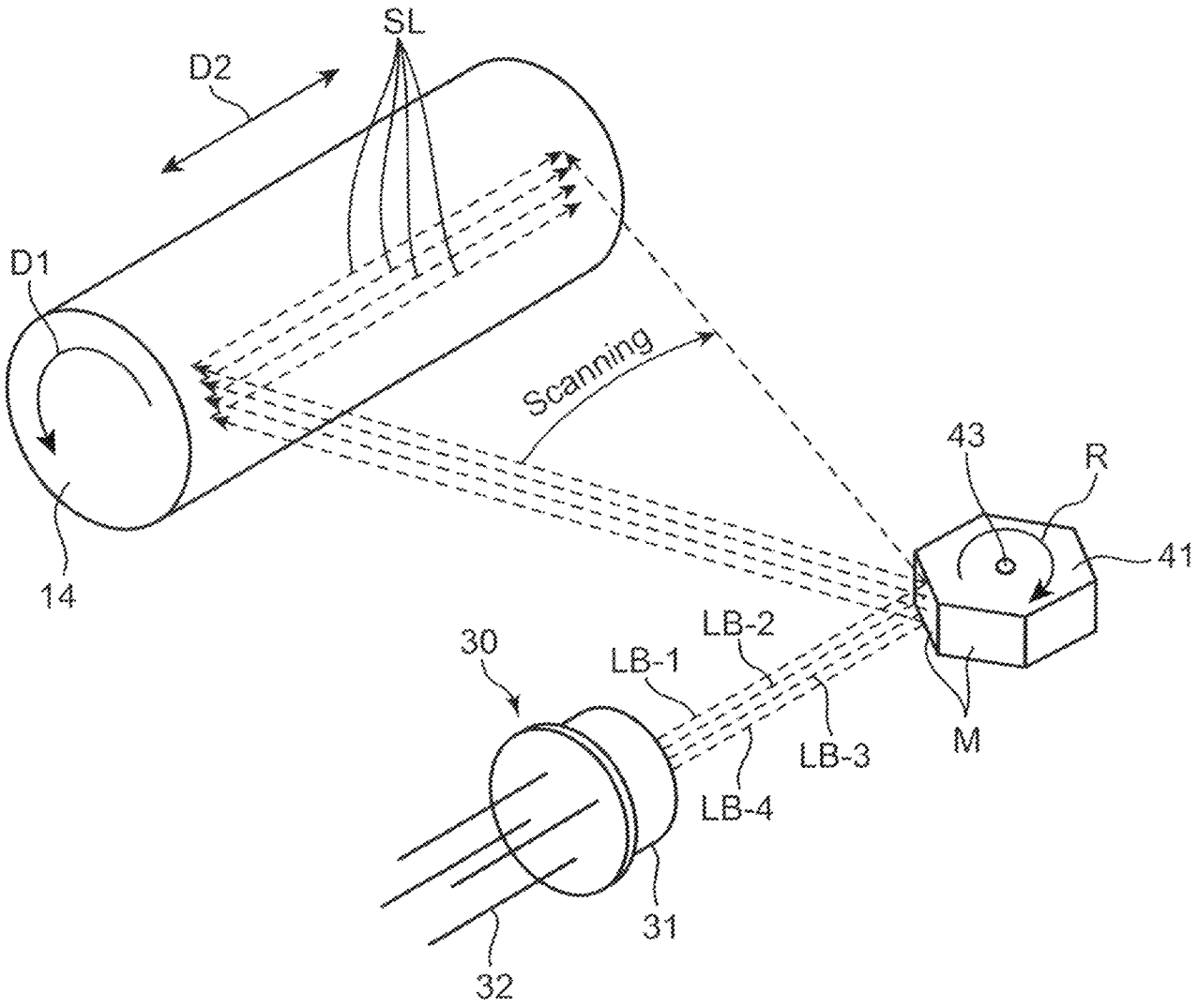
FIG. 3 is a schematic perspective view for describing an exposure mode on a photosensitive drum adopting a multi beam method.
Figure 4:
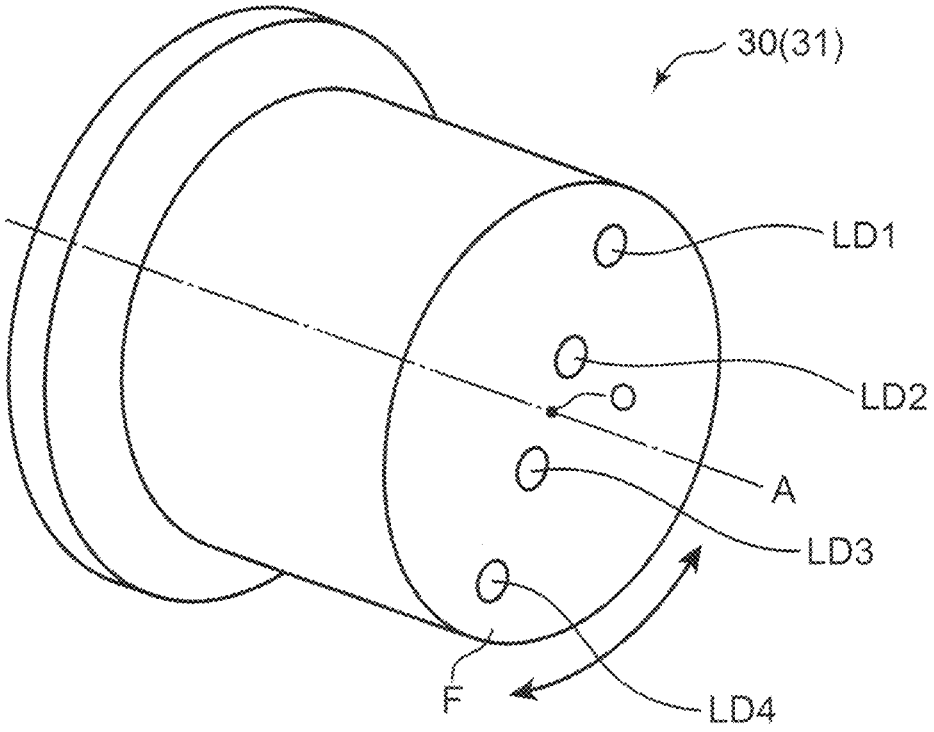
FIG. 4 is a perspective view showing a multi beam light emitting portion of a light source part.

The laser light source unit 30 is a multi beam light source capable of emitting a plurality of beams arranged in the main scanning direction. The laser light source unit 30 includes a multi beam light emitting portion 31, and a lead portion 32 for supplying electricity to the multi beam light emitting portion 31. FIG. 3 is a schematic perspective view for describing an exposure mode on the photosensitive drum 14 adopting a multi beam method, and FIG. 4 is a perspective view showing the multi beam light emitting portion 31.

The multi beam light emitting portion 31 is a light emitting portion which includes a circular columnar plug member, and four laser diodes (LD; light emitting elements) arranged on a distal end surface F of the plug member in a row at a fixed interval. That is, the multi beam light emitting portion 31 is a monolithic multi-laser diode where a first light emitting portion LD1, a second light emitting portion LD2, a third light emitting portion LD3, and a fourth light emitting portion LD4 are disposed. The first to fourth light emitting portions LD1 to LD4 are arranged on a line which makes inclination angles with respect to the main scanning direction and a sub scanning direction respectively. As shown in FIG. 3, the first, the second, the third, and the fourth light emitting portions LD1, LD2, LD3, and LD4 emit beams LB-1, LB-2, LB-3, and LB-4 respectively. In FIG. 3 and FIG. 4, the monolithic multi-laser diode having four LDs is exemplified as the multi beam light emitting portion 31. However, it is sufficient that the light source part has at least two or more LDs. A multi beam light emitting portion 31 having eight LDs, that is, the LD1 to the LD8 is exemplified later.

The collimator lens 51 is a lens which converts beams LB-1 to LB-4 which are emitted from the laser light source unit 30 and are diffused, into parallel lights. The cylindrical lens 52 is a lens which converts the beams LB-1 to LB-4 in the form of the parallel lights into a linear light elongated in the main scanning direction, and images the linear light on the polygon unit 40 (polygon mirror 41).

The polygon unit 40 includes the polygon mirror 41 and a polygon motor 42. The polygon mirror 41 has a plurality of mirror surfaces M on which beams LB-1 to LB-4 focused by the cylindrical lens 52 are incident. The polygon mirror 41 deflects the beams LB-1 to LB-4, and the peripheral surface of the photosensitive drum 14 is scanned by these beams LB-1 to LB-4. The polygon mirror 41 rotates at a predetermined speed in the direction indicated by an arrow R, and deflects the beams LB-1 to LB-4 such that the beams LB-1 to LB-4 perform scanning in the longitudinal direction (main scanning direction) of the photosensitive drum 14. The polygon motor 42 generates a rotational force for rotating the polygon mirror 41 at a predetermined speed. The polygon mirror 41 is connected to a rotary shaft 43 of the polygon motor 42, and polygon mirror 41 rotates about an axis of the rotary shaft 43.

The first scanning lens 53 and the second scanning lens 54 are lenses respectively having an fθ characteristic. These scanning lenses 53, 54 are disposed in an opposedly facing manner with each other on an optical axis extending from the polygon mirror 41 to the peripheral surface of the photosensitive drum 14. The first, second scanning lenses, 53, 54 converge the beams LB-1 to LB-4 reflected by the polygon mirror 41, and form an image on the peripheral surface of the photosensitive drum 14.

The mirror 55 reflects the beams LB-1 to LB-4 emitted from the first scanning lens 53 and the second scanning lens 54 toward an opening portion (not shown in the drawing) formed in the housing 11H such that the beams LB-1 to LB-4 are radiated to the photosensitive drum 14. The first converging lens 56A and the second converging lens 56B are disposed on optical paths outside a range of an effective scanning region on the peripheral surface of the photosensitive drum 14 by the polygon mirror 41. The first converging lens 56A and the second converging lens 56B are lenses provided for imaging the respective beams LB-1 to LB-4 on the first BD sensor 6A and the second BD sensor 6B.

The first BD sensor 6A and the second BD sensor 6B detect beams for synchronizing writing start timings at which radiation of beams to the peripheral surface of the photosensitive drum 14 is started with respect to one scanning line SL. The first BD sensor 6A is disposed on a scanning start side of the scanning line SL, and the second BD sensor 6B is disposed on a scanning finish side of the scanning line SL. The first, second BD sensors 6A, 6B are formed of a photodiode or the like respectively. These sensors 6A, 6B output a signal of high level when a laser beam is not detected, and output a signal of low level during a period the laser beam passes light receiving surfaces of the sensors 6A, 6B.

To describe with reference to FIG. 3, four beams LB-1 to LB-4 are emitted from the LD1 to the LD4 of the multi beam light emitting portion 31 toward mirror surfaces M of the polygon mirror 41. The polygon mirror 41 rotates at a high speed in the direction of an arrow R about an axis of the rotary shaft 43 by the polygon motor 42. At one timing, four beams LB-1 to LB-4 are radiated to one mirror surface M among the plurality of mirror surfaces M, and is reflected (deflected) in the direction toward the peripheral surface of the photosensitive drum 14 by the mirror surface M. Along with the rotation of the polygon mirror 41, four beams LB-1 to LB-4 scan the peripheral surface of the photosensitive drum 14 along the main scanning direction D2. Accordingly, four scanning lines SL are drawn on the peripheral surface of the photosensitive drum 14. The beams LB-1 to LB-4 are modulated corresponding to image data and hence, an electrostatic latent image corresponding to image data is formed on the peripheral surface of the photosensitive drum 14.

In such an operation, four beams LB-1 to LB-4 draw four scanning lines SL in the main scanning direction D2 in a state where the beams LB-1, LB-2, LB-3, and LB-4 are arranged in this order in the sub scanning direction D1 (the rotational direction of the photosensitive drum 14 in FIG. 3). That is, the beam LB-1 is disposed on a most upstream side in the sub scanning direction D1, and the beam LB-4 is disposed on a most downstream side. That is, the beam LB-1 performs scanning in the main scanning direction D2 prior to the beam LB-4 in time. This is because that, as shown in FIG. 4, four light emitting portions LD1 to LD4 are arranged in a straight line shape at fixed intervals. Accordingly, beam pitches of the beams LB-1 to LB-4 in the sub scanning direction, that is, the resolution (dpi) of an image to be drawn depends on arrangement pitches of four light emitting portions LD1 to LD4. The selection of the beam which is used for scanning in the main scanning direction D2 prior to other beams among four beams LB-1 to LB-4 may be decided not based on physical arrangement of the light emitting portions LD1 to LD4 but based on the light emitting portion to which a light emitting signal is firstly applied among the light emitting portions LD1 to LD4.

The above-mentioned beam pitches can be adjusted by rotating the multi beam light emitting portion 31 about an axis of the holder member not shown in the drawing. Specifically, using a normal line A which passes the center O of a distal end surface F of the multi beam light emitting portion 31 as an axis of rotation, by rotating the multi beam light emitting portion 31 in the direction indicated by an arrow in the drawing, the arrangement pitches of the first to fourth light emitting portions LD1 to LD4 can be changed in appearance. That is, when the multi beam light emitting portion 31 is rotated in a clockwise direction about an axis of the normal line A, a beam pitch in the sub scanning direction becomes small. On the other hand, when the multi beam light emitting portion 31 is rotated in a counterclockwise direction about the axis of the normal line A, the beam pitch in the sub scanning direction becomes large. Accordingly, the beam pitch corresponding to set resolution of an image can be acquired by adjusting the rotation of the multi beam light emitting portion 31.

[Electrical Configuration of Image Forming Apparatus]

Figure 5:
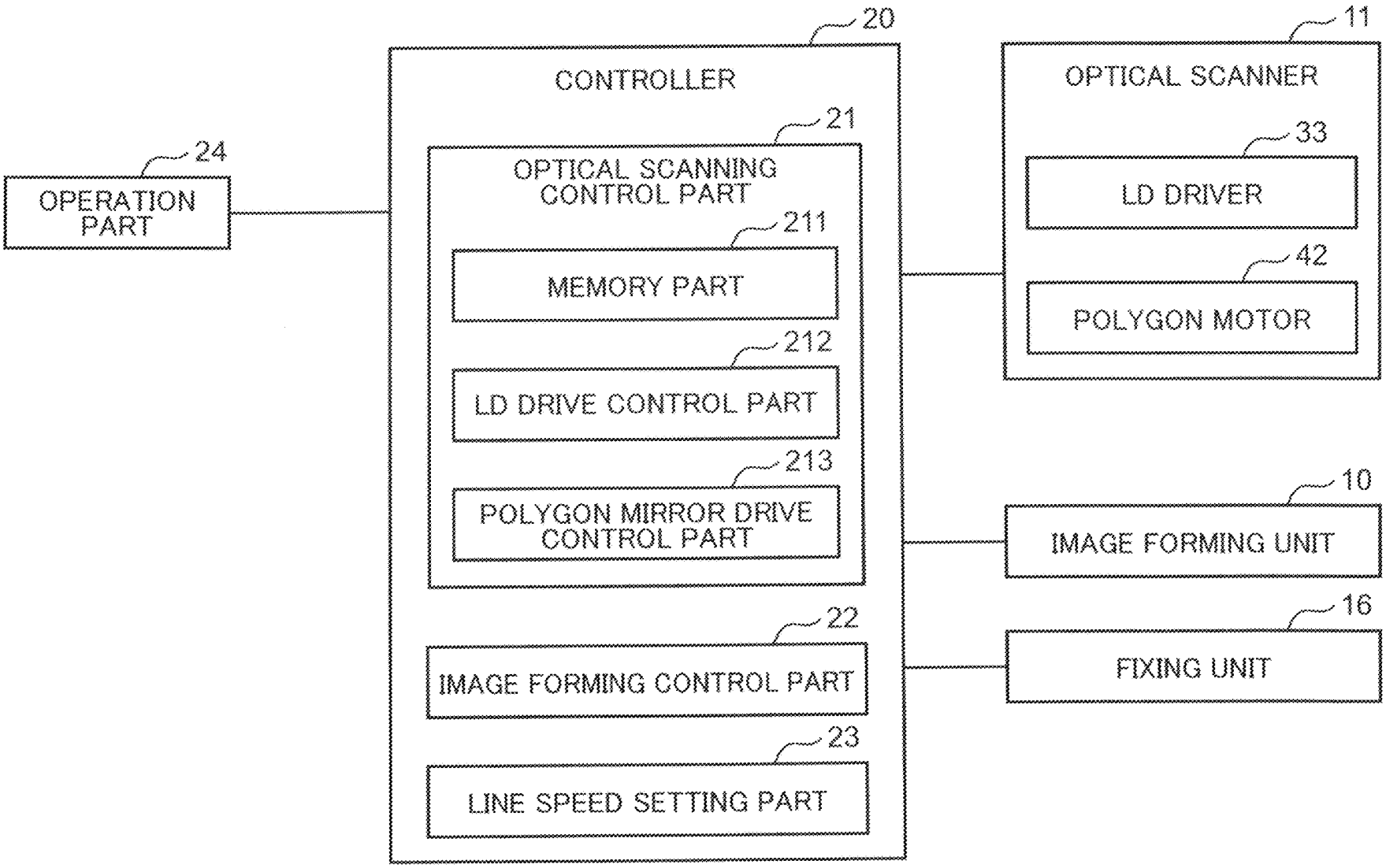
FIG. 5 is a block diagram showing the electrical configuration of the image forming apparatus.

FIG. 5 is a block diagram showing the electrical configuration of the image forming apparatus 1. The image forming apparatus 1 includes: a controller 20 which comprehensively controls operations of the respective parts of the image forming apparatus 1; and an operation part 24. The controller 20 is formed of: a central processing unit (CPU); a read only memory (ROM) which stores a control program; a random access memory (RAM) which is used as a working area of the CPU and the like.

The operation part 24 includes a touch panel, a numeric keypad, a start key, a setting key and the like, and receives operations of a user and various setting with respect to the image forming apparatus 1. For example, the operation part 24 receives setting of a printing object sheet relating to a line speed of the image forming unit 10 from a user.

The controller 20 controls the respective parts of the image forming apparatus 1 by allowing the CPU to execute control programs stored in the ROM thus controlling an image forming operation by the image forming apparatus 1. The controller 20 includes an optical scanning control part 21, an image forming control part 22 and a line speed setting part 23. The image forming control part 22 mainly controls operations of the image forming unit 10 and the fixing unit 16. The optical scanning control part 21 functions as a control part for controlling an optical scanning operation applied to the peripheral surface of the photosensitive drum 14 by the optical scanner 11.

The line speed setting part 23 sets a line speed corresponding to an operation condition of the image forming unit 10. For example, the line speed setting part 23 operates the image forming unit 10 at a predetermined normal line speed when a sheet which is an object to be printed is a plain paper, and the line speed setting part 23 sets a line speed slower than the normal line speed when the sheet is a thick sheet which requires time in fixing a toner image. For example, such a line speed is set to ½ of the normal speed.

The optical scanning control part 21 functionally includes a memory part 211, an LD drive control part 212 (control part), and a polygon mirror drive control part 213. In the memory part 211, various setting information relating to the scanning optical system, measurement information such as equal magnification information measured for respective mirror surfaces M of the polygon mirror 41 and the like are stored. In the memory part 211, information relating to concentration irregularities measured in advance is also stored.

Specifically, a latent image of concentration irregularities measurement-use chart is formed by scanning the surface to be scanned (the peripheral surface of the photosensitive drum 14) by the above-mentioned scanning optical system, the latent image is developed, and the chart is printed on a sheet. A concentration irregularities characteristic in the main scanning direction is acquired by measuring the chart using the concentration sensor, and light quantity correction data (one example of profile data) prepared based on the characteristic is stored in the memory part 211. This light quantity correction data is data for correcting light quantities of beams which the respective LDs of the multi beam light emitting portion 31 emit for eliminating concentration irregularities. That is, the light quantity correction data is data which includes a profile where the respective positions in the main scanning direction and the correction light quantities are associated with each other. In this embodiment, light quantity correction position (light quantity change positions) are fixedly set in advance (for example, the positions set at a pitch of 10 mm in the main scanning direction), and these respective positions cannot be changed.

The optical scanner 11 includes an LD driver 33 which is a driver for driving the light emitting portions LD1 to LD4. The LD drive control part 212 controls the LD driver 33 so as to make the respective light emitting portions LD1 to LD4 radiate beams LB-1 to LB-4 by emitting light with required light quantities at necessary timings corresponding to data of an image (latent image) to be formed. The LD drive control part 212 corrects light quantities at the respective positions in the main scanning direction by looking up light quantity correction data stored in the memory part 211.

The polygon mirror drive control part 213 supplies a rotation control signal for rotating the polygon mirror 41 to the polygon motor 42. The polygon motor 42 rotatably drives the polygon mirror 41 in accordance with the rotation control signal. In this embodiment, the polygon mirror drive control part 213 keeps a rotational speed of the polygon mirror 41 at a fixed value even when the line speed setting part 23 changes a line speed. Alternatively, the LD drive control part 212 performs a control of increasing or decreasing the number of beams radiated from the multi beam light emitting portion 31. For example, assuming that eight beams are radiated from the multi beam light emitting portion 31 at a normal line speed, the multi beam light emitting portion 31 radiates four beams when a line speed is decreased to a ½ line speed. With such a control, compared to the case where a rotational speed of the polygon mirror 41 is changed, the control becomes easy and, at the same time, scanning can be performed substantially in the same manner as the case where the rotational speed of the polygon mirror is changed.

[Detail of LD Drive Control Part]

Figure 6:
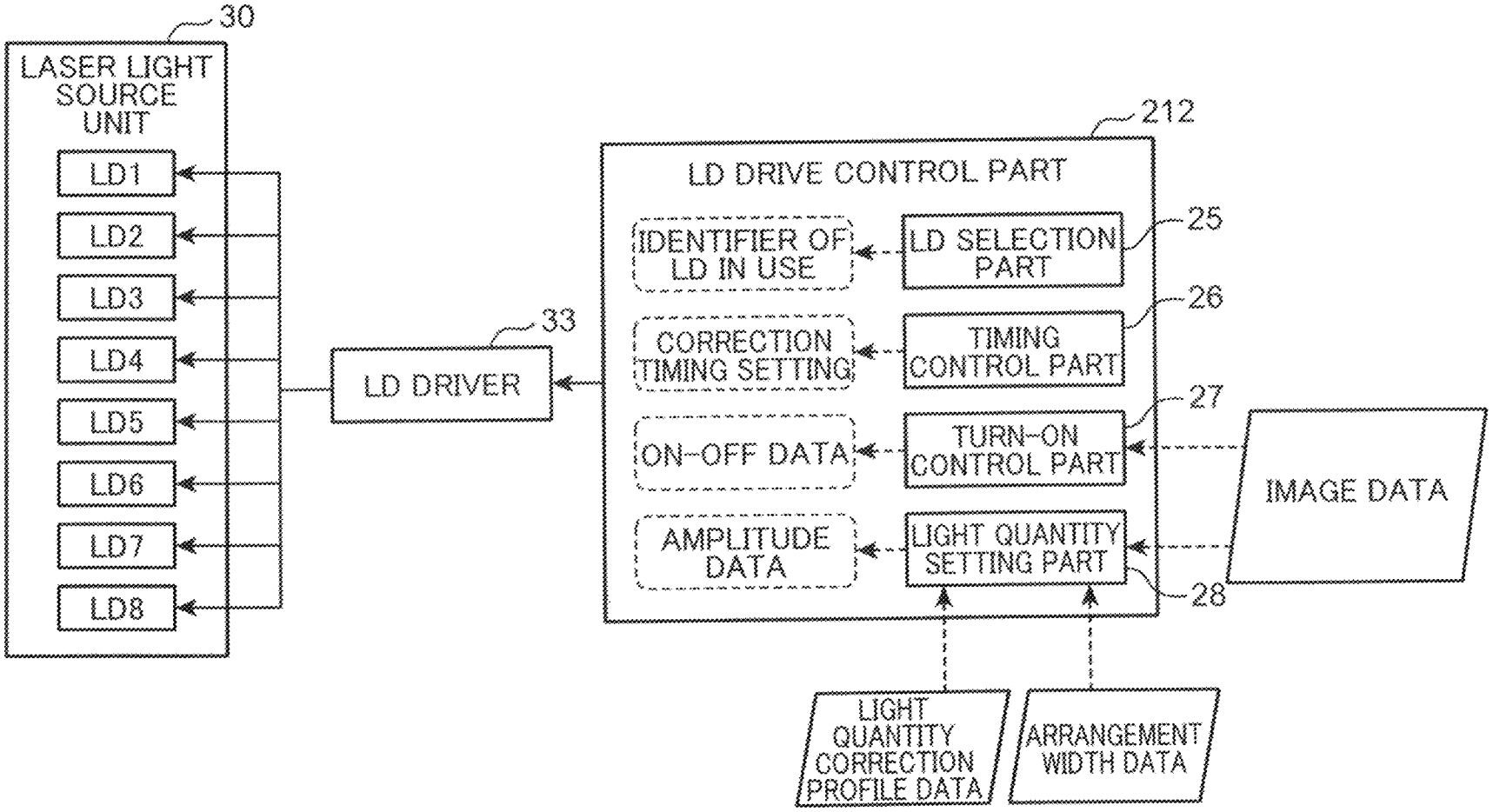
FIG. 6 is a block diagram showing the detailed configuration of an LD drive control part.

The above-mentioned LD drive control part 212 is further described. FIG. 6 is a block diagram showing the detailed configuration of the LD drive control part 212. The LD drive control part 212 is provided for controlling a turn-on operation and light quantities of the plurality of LDs which the multi beam light emitting portion 31 includes. The LD drive control part 212 functionally includes an LD selection part 25, a timing control part 26, a turn-on control part 27 and a light quantity setting part 28. In FIG. 6, an example is shown where the laser light source unit 30 includes a light source which can generate eight beams at maximum. That is, FIG. 6 shows the example where the multi beam light emitting portion 31 includes eight LDs, that is, the LD1 to the LD8.

The LD selection part 25 specifies a plurality of beams used for scanning as selected beams out of eight beams (the LD1 to the LD8). For example, the LD selection part 25 changes the number of selected beams corresponding to a line speed of image forming processing. As a specific example, when the line speed setting part 23 sets a normal line speed, the LD selection part 25 selects all of the LD1 to the LD8 as the selected beams, while when a ½ line speed is set, the LD selection part 25 selects the LD1 to the LD4 which form an arrangement portion which is a half of the LD1 to the LD8 as the selected beams. Besides the above-mentioned case, for the purpose of increasing resolution, for example, a case where seven LDs are specified as the selected beams among the LD1 to the LD8 or the like can be also exemplified. The LD selection part 25 supplies information such as identifiers of the specified LDs to the LD driver 33 as the selected beams.

The timing control part 26 sets timings of changing light quantities of the respective selected beams based on the same profile data at the respective positions in the main scanning direction. In this embodiment, the above-mentioned profile data is light quantity correction data for cancelling concentration irregularities. Further, this embodiment does not adopt a technique where light quantity correction is performed at different timings for correcting light quantities of a plurality of respective selected beams arranged at intervals in the main scanning direction at the same main scanning position respectively. This is because, in this case, a control for applying the above-mentioned profile data to the respective selected beams by delaying timings becomes complicated and hence, a circuit scale becomes large. Accordingly, on the premise that light quantities of the respective selected beams are corrected at the same change (correction) timing based on the profile data, the timing control part 26 sets correction timing for such correction and supplies the correction timing to the LD driver 33. Although described in detail later, the above-mentioned correction timing is set to timing at which the center position of the arrangement width of eight LDs, that is, the LD1 to the LD8 pass the main scanning position which is fixedly set in advance as the light quantity correction position.

The turn-on control part 27 generates video data which turns on or off the respective LDs of the selected beams corresponding to image data for forming an image, and supplies the video data to the LD driver 33. This ON-OFF data is data for determining the position (timing) in the main scanning direction at which light is emitted and for determining the LD by which light is emitted during scanning.

The light quantity setting part 28 generates amplitude data for determining light quantities of the respective LDs of the selected beams corresponding to the above-mentioned image data and light quantity correction data stored in the memory part 211, and supplies the amplitude data to the LD driver 33. Further, in this embodiment, the light quantity setting part 28 generates amplitude data by modifying light quantity correction data corresponding to arrangement width data indicative of an arrangement width in the main scanning direction of the selected beams which the LD selection part 25 selects. Amplitude data is data for determining the position (timing) at which the LD turned on by the turn-on control part 27 emits light and a light quantity of the LD. Specifically, amplitude data is data in which a drive current of the LD and supply timing of the electric current are associated with each other. The drive current is an electric current which is obtained by correcting a basic drive current with which dots having concentration corresponding to image data can be printed in accordance with light quantity correction data. The above-mentioned timing control part 26 supplies a timing signal for supplying the drive current to the LD driver 33 corresponding to light quantity correction data.

[Error in Correction of Concentration Irregularities]

Figure 7A:
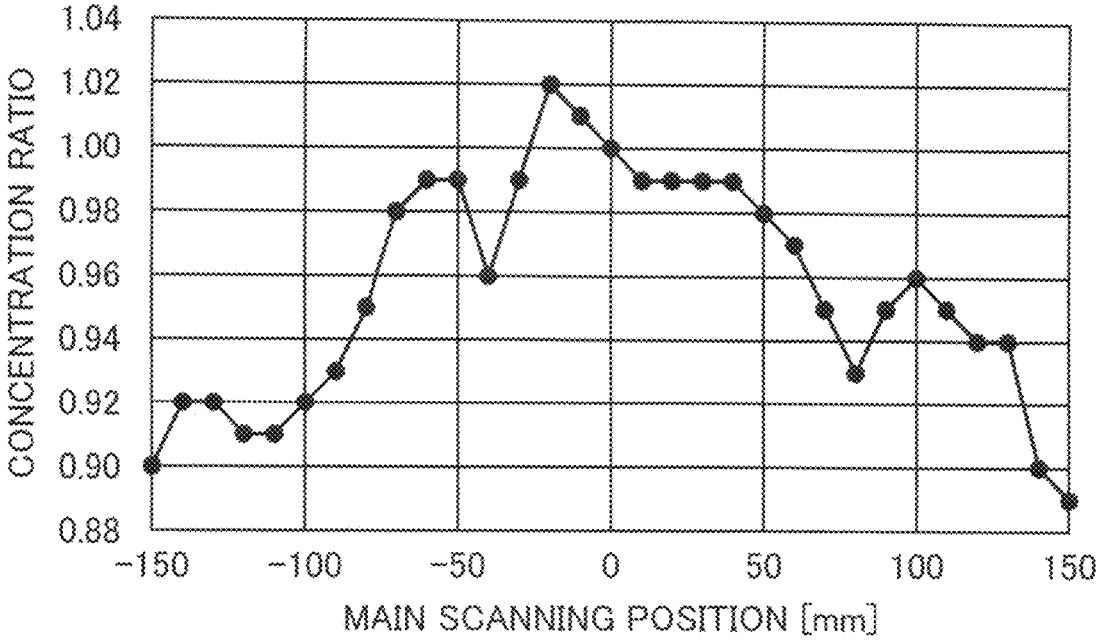
FIG. 7A is a graph showing one example of concentration irregularities in a main scanning direction.

FIG. 7A is a graph showing one example of concentration irregularities in the main scanning direction of a tonner image obtained by scanning a surface to be scanned by the beams of optical scanner 11 with the same set light quantity and by developing a latent image formed on the surface to be scanned. The graph shows concentration ratios at other main scanning positions with toner concentration at the main scanning position where an image height is 0 mm set to 1. Even when scanning is performed with a drive current of the LDs of the laser light source unit 30 set to a fixed value, concentration irregularities unavoidably occur as shown in FIG. 7A due to exposure irregularities of the photosensitive drum 14, an error in assembling a scanning optical system of the optical scanner 11, irregularities in characteristic of optical parts or the like.

Figure 7B:
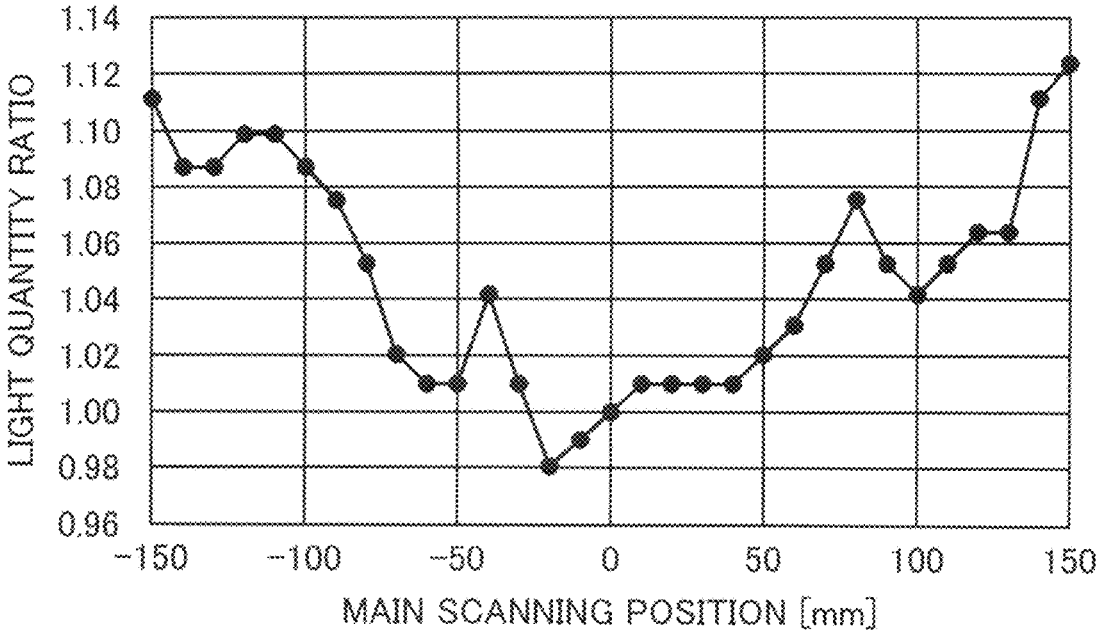
FIG. 7B is a graph showing one example of a light quantity correction profile for correcting the concentration irregularities.

FIG. 7B is a graph showing one example of a light quantity correction profile for correcting the above-mentioned concentration irregularities. This graph also shows light quantity ratios at other main scanning positions with a light quantity at the main scanning position where an image height is 0 mm set to 1. Assume that a proportional relationship exists between toner concentration and exposure power, as shown in FIG. 7B, by setting the light quantity correction profile having a mirror characteristic (an opposite characteristic) with respect to a characteristic of the concentration ratios shown in FIG. 7A, the correction which cancels the above-mentioned concentration irregularities can be performed.

Figure 8A:
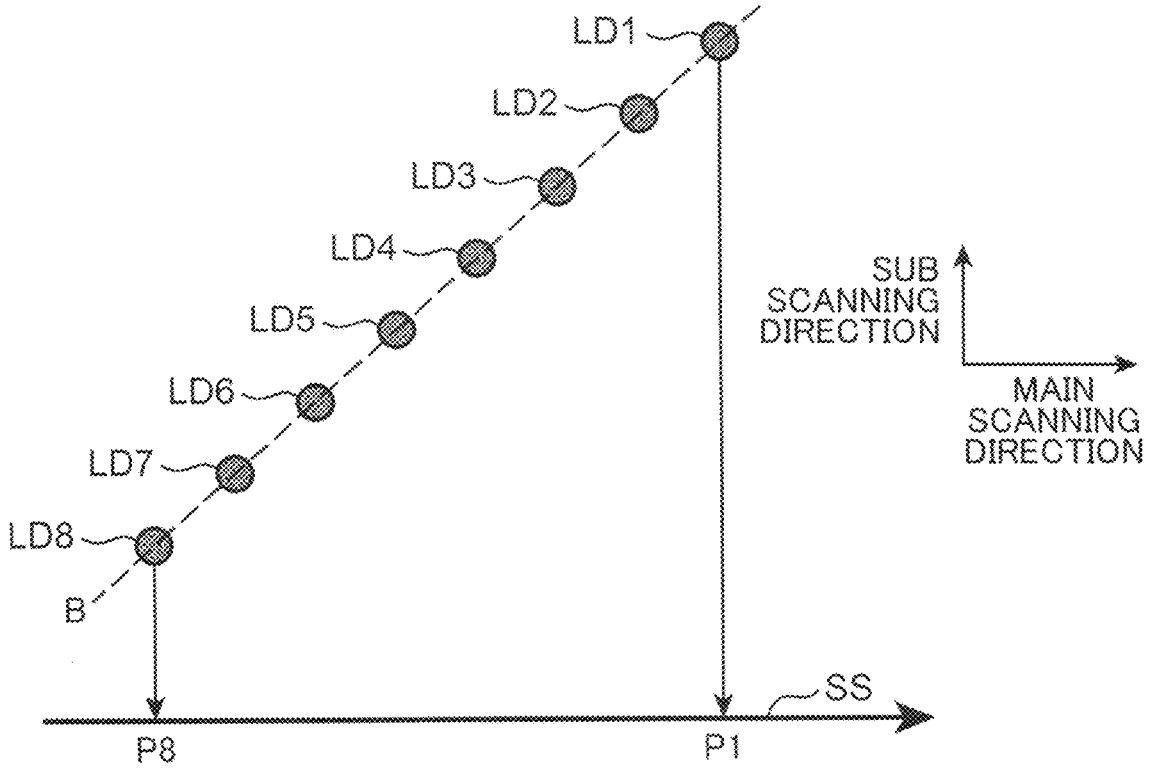
FIG. 8A is a schematic view showing a positional relationship between respective LDs of the multi beam light emitting portion and a surface to be scanned.

FIG. 8A is a schematic view showing a positional relationship between the respective LD1 to LD8 of the multi beam light emitting portion 31 and the surface to be scanned SS (the peripheral surface of the photosensitive drum 14). As described previously with reference to FIG. 4, the LD1 to the LD8 are arranged on the LD arrangement line B having inclination angles with respect to the main scanning direction and the sub scanning direction respectively. Accordingly, the LD1 to the LD8 are disposed at different positions in the main scanning direction which is the scanning direction.

Figure 8B:
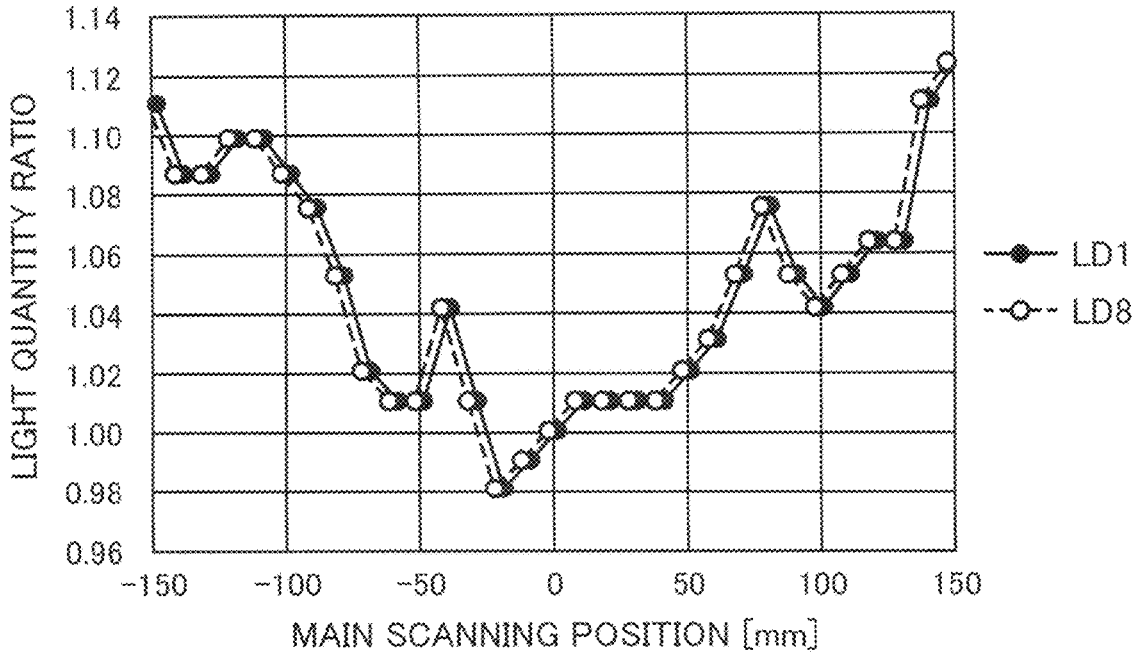
FIG. 8B is a graph showing main scanning positions on the surface to be scanned to which the LD1 and the LD8 are radiated at the same timing.

FIG. 8B is a graph showing the main scanning positions on the surface to be scanned SS to which the LD1 and the LD8 respectively radiate when the LD1 and the LD8 are made to emit light at the same timing. For example, assuming that the LD1 to the LD8 are arranged in the main scanning direction at a pitch of 0.1 mm, the LD1 positioned on a most downstream side in the main scanning direction and the LD8 positioned on a most upstream side are spaced apart from each other by 0.7 mm in the main scanning direction. Assuming a magnification in the main scanning direction in the optical scanner 11 of the scanning optical system is eight times, when the LD1 and the LD8 are made to emit light at the same timing, the main scanning position P1 at which the beams of the LD1 are respectively radiated to the surface to be scanned SS and the main scanning position P8 at which the beams of the LD8 are respectively radiated to the surface to be scanned SS are spaced apart from each other in the main scanning direction by 5.6 mm. Although the plots of the LD2 to the LD7 are not described in FIG. 8B, the plots of the LD2 to the LD7 exist between the plot of the LD1 and the plot of the LD8.

Accordingly, by performing the correction of light quantities of the LD1 to the LD8 at the same timing based on one profile data shown in FIG. 7B at the respective positions in the main scanning direction, there arises an error in correction of concentration irregularities attributed to the fact that the radiation position differs between the LD1 to the LD8. For example, assume that the above-mentioned profile data shows "the increase of light quantity by +2%" at the main scanning position where a height of an image is 50 mm. Then, assume that the light quantity correction of "the increase of light quantity by +2%" is performed altogether with respect to the LD1 to the LD8 at timing that the beam which the LD1 emits at the time of scanning passes the main scanning position where a height of an image is 50 mm.

In this case, with respect to the beam LD1, the light quantity correction can be performed exactly in accordance with the above-mentioned profile data. However, with respect to the beam of the LD8, even when the main scanning position is shifted by 5.6 mm from the position where a height of an image is 50 mm, the light quantity correction of "the increase of light quantity by +2%" is performed with a height of image set to 50 mm. The substantially same problem arises also with respect to the LD2 to the LD7 although a level of significance is not so high compared to the LD8. That is, the light quantity correction is not performed in accordance with the profile data. This becomes a factor which causes an error in correction of the concentration irregularities.

[Control for Suppressing Error in Correction of the Concentration Irregularities]

Although the occurrence of the above-mentioned error in correction is plausible, it is indispensable to perform a correction of light quantities of the LD1 to the LD8 at the same timing based on one profile data from a viewpoint of suppressing a control from becoming complicated or suppressing the increase of a scale of the circuit. Accordingly, it is important to suppress as much as possible the occurrence of error in correction of concentration irregularities attributed to the difference in radiation position among the beams of the LD1 to the LD8 in the main scanning direction. However, in this embodiment, the main scanning positions (light quantity change positions) where light quantity correction can be performed are fixedly determined. Accordingly, it is necessary to suppress error in correction without adopting a method where light quantity correction timing is shifted.

In view of the above-mentioned points, in this embodiment, the light quantity setting part 28 (FIG. 6) modifies light quantities at the respective light quantity correction positions when the position of a center region in an arrangement width in the main scanning direction of the plurality of selected beams specified by the LD selection part 25 is moved in the main scanning direction in response to selection modes of the beams. That is, in this embodiment, at the respective light quantity change positions which are fixedly set, light quantities of the respective selected beams are corrected as the same change timing based on light quantity correction data (profile data) shown in FIG. 7B. In such an operation, light quantity setting part 28 modifies correction light quantities at the respective light quantity change positions such that a shift light quantity at the position shifted corresponding to the movement of the center region of the arrangement width in the main scanning direction is applied in the light quantity correction data. Such a control is described with reference to FIG. 9 to FIG. 15B.

Figure 9:
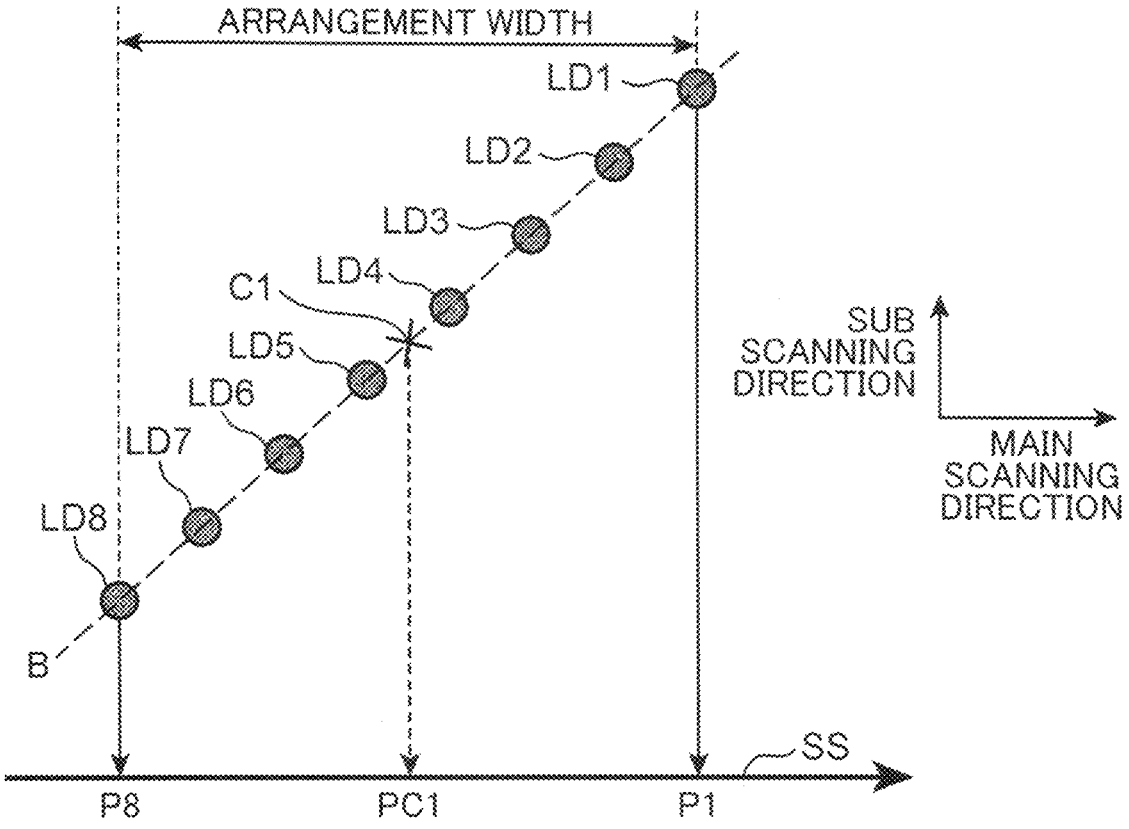
FIG. 9 is a schematic view for describing a positional relationship between a center position of an arrangement width of eight LDs and light quantity correction positions when eight LDs are used.

FIG. 9 is a schematic view for describing light quantity correction timing when eight LDs consisting of the LD1 to the LD8 are used, that is, when the LD selection part 25 selects all of the LD1 to the LD8 as the selected beams. In this case, the arrangement width becomes the distance from the LD1 to the LD8 in the main scanning direction. On the surface to be scanned SS, a distance between the main scanning position P1 scanned by the beam emitted from the LD1 and the main scanning position P8 scanned by the beam emitted from the LD8 becomes the arrangement width. In FIG. 9, a center point C1 of the arrangement width in the main scanning direction (the center region of the arrangement width) is shown.

The timing control part 26 performs the light quantity correction which conforms with profile data shown in FIG. 7B with reference to an imaginary main scanning position PC1 on the surface to be scanned SS corresponding to the center point C1. As in the example described previously, assume that the profile data exhibits "the increase of light quantity by +2%" at the main scanning position where a height of an image is 50 mm. In this case, the timing control part 26 outputs a timing signal to the LD driver 33 such that light quantity correction of "the increase of light quantity by +2%" is performed with respect to the LD1 to the LD8 at a timing that an imaginary main scanning position PC1 passes the main scanning position where a height of an image is 50 mm. In this embodiment, this imaginary main scanning position PC1 is fixed.

The main scanning position P1 is deviated toward a downstream side of the imaginary main scanning position PC1, and the main scanning position P8 is deviated toward an upstream side of the imaginary main scanning position PC1 and hence, an error in correction occurs when the imaginary main scanning position PC1 is used as the reference. However, the imaginary main scanning position PC1 is disposed at the intermediate position between the main scanning positions P1, P8. Accordingly, errors in correction of the LD1 to the LD4 on the downstream side and the errors in correction of the LDS to the LD8 on the downstream side cancel each other and hence, errors in correction can be suppressed to a low level eventually.

Figure 11A:
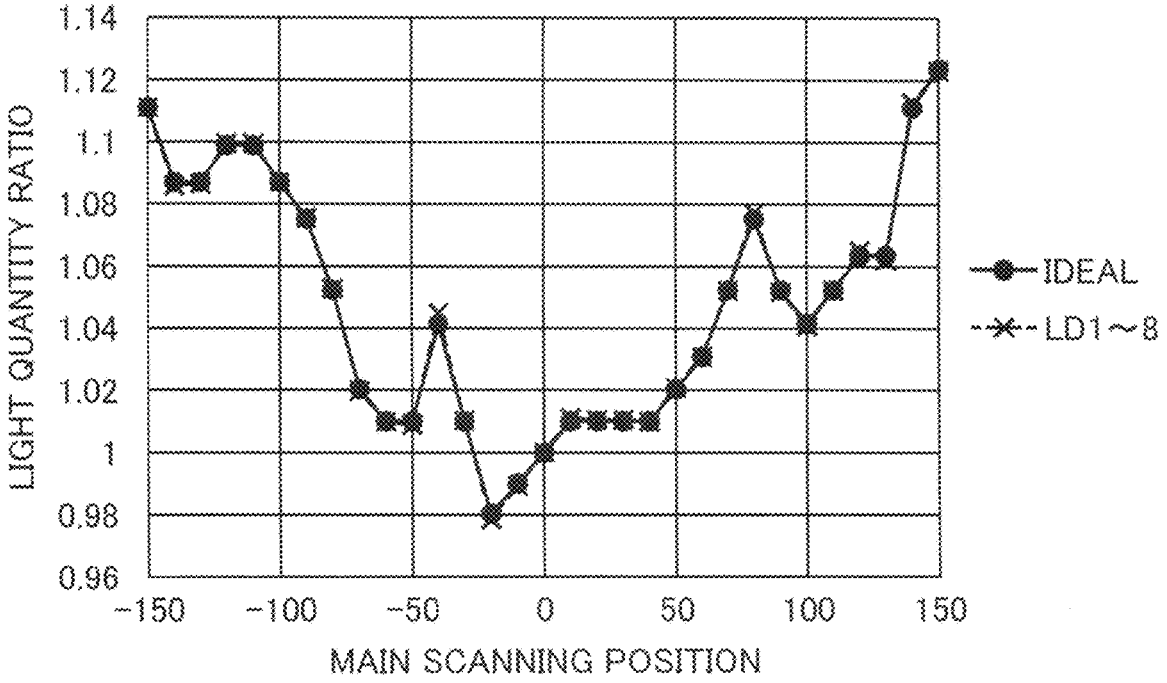
FIG. 11A is a graph showing deviation between ideal light quantity correction and an average light quantity correction value of eight beams when the positional relationship shown in FIG. 9 is applied.
Figure 11B:
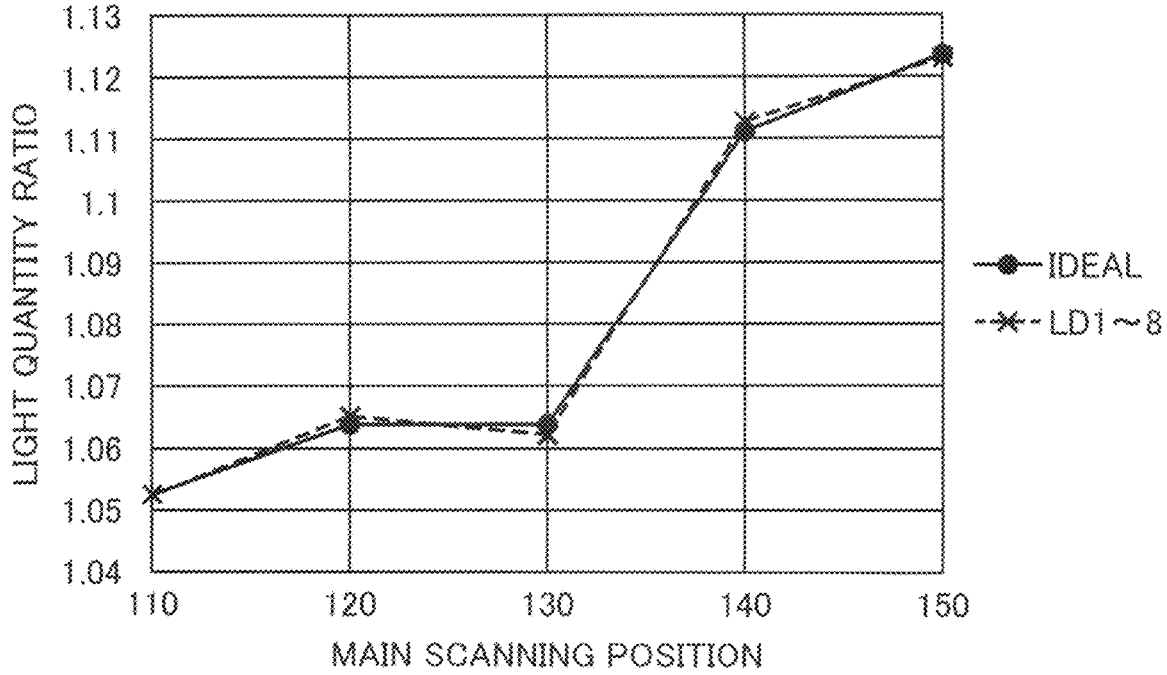
FIG. 11B is a graph showing a portion of FIG. 11A in an enlarged manner.

FIG. 11A is a graph showing a deviation between the profile of an ideal light quantity correction value (the profile shown in FIG. 7B) and an average light quantity correction value of eight beams, that is, the LD1 to the LD8 to which the light quantity correction timing control shown in FIG. 9 is applied. FIG. 11B is a graph showing a range where a height of an image shown in FIG. 11A is 110 to 150 mm in an enlarged manner. As can be clearly understood from these graphs, it is found that, in the case of eight beams, the light quantity correction is performed using the center point C1 of the arrangement width between the selected LD1 to the selected LD8 as the reference and hence, substantially no difference exists between the ideal profile and the profile of the average light quantity correction value of the eight beams. That is, it is found that an error in the concentration correction is favorably suppressed.

Figure 10A:
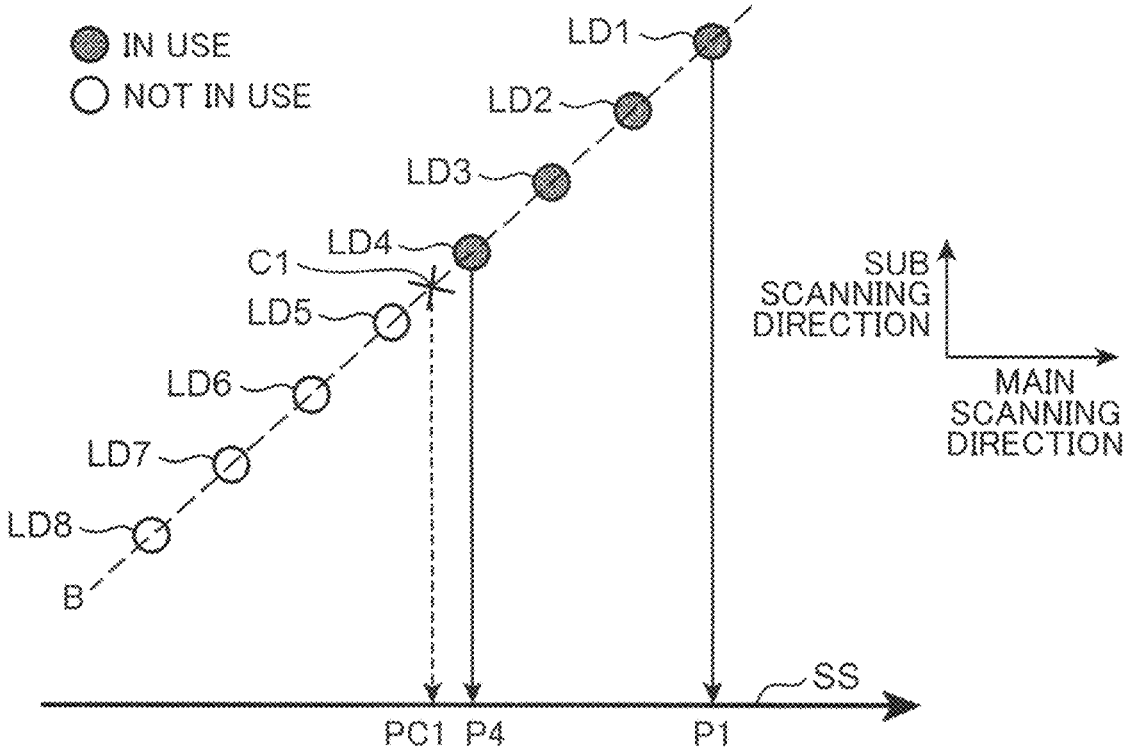
FIG. 10A is a schematic view for describing a positional relationship between a center position of an arrangement width of four LDs and light quantity correction positions when four LDs are used.

Next, FIG. 10A is a schematic view for describing the light quantity correction timing when four LDs formed of the LD1 to the LD4 are used, that is, when the LD selection part 25 selects the LD1 to the LD4 as the selected beams. In this case, the arrangement width becomes a distance from the LD1 to the LD4 in the main scanning direction, and the arrangement width becomes shorter compared to the case where all of the LD1 to the LD8 are used. On the surface to be scanned SS, a distance between the main scanning position P1 where the LD1 emits the beam and the main scanning position P4 where the LD4 emits the beam becomes the arrangement width. In this case, imaginary main scanning position PC1 is positioned not only away from the center point of the arrangement width of the LD1 to the LD4 but also positioned outside a range of the arrangement width.

Figure 12A:
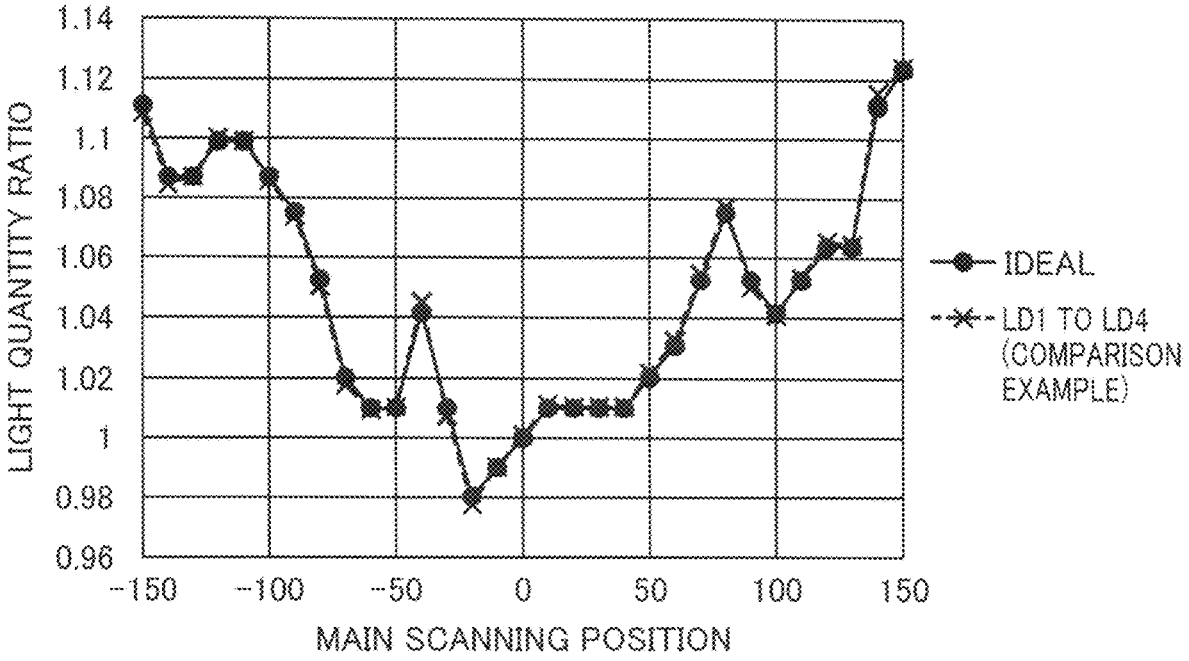
FIG. 12A is a graph showing deviation between ideal light quantity correction and an average light quantity correction value of four beams when the positional relationship shown in FIG. 10A is applied.
Figure 12B:
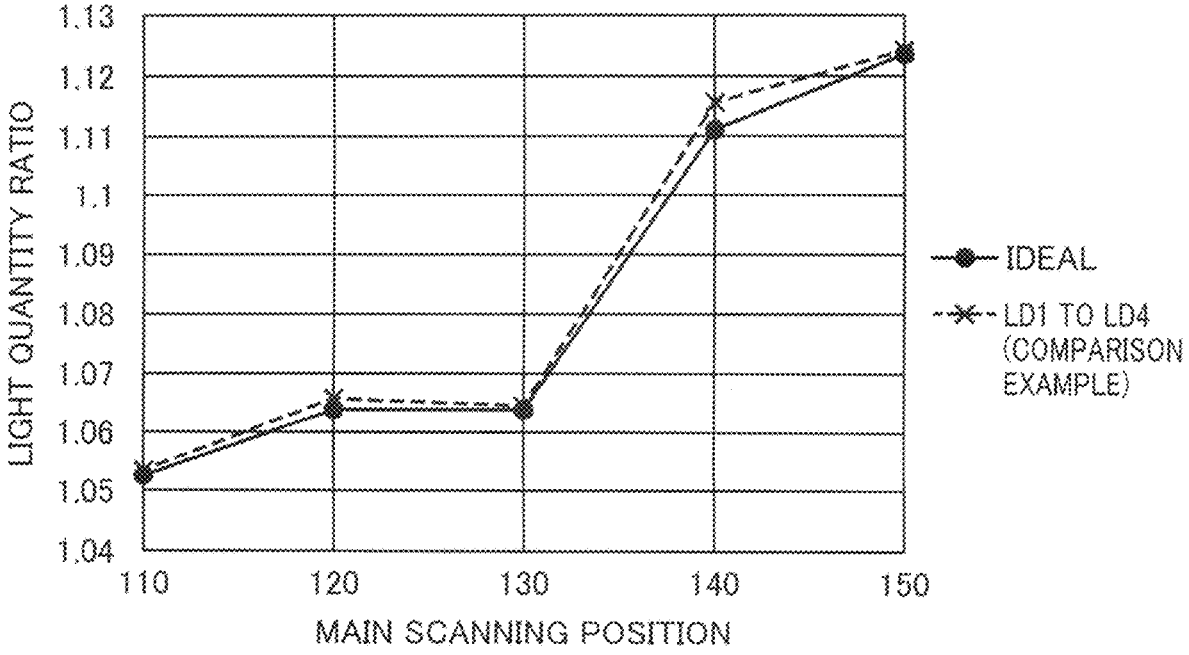
FIG. 12B is a graph showing a portion of FIG. 12A in an enlarged manner.

FIG. 12A is a graph showing a deviation between the profile of an ideal light quantity correction value and an average light quantity correction value of four beams when light quantity correction is performed using the imaginary main scanning position PC1 positioned outside the range of arrangement width of the LD1 to the LD4 as the reference as shown in FIG. 10A. FIG. 12B is a graph showing a range where a height of an image shown in FIG. 12A is 110 to 150 mm in an enlarged manner. As can be clearly understood from these graphs, a significant divergence is recognized between the ideal profile and the profile of the average light quantity correction value of four beams to which the control of the comparison example is applied. It is particularly found that the divergence is increased when a height of an image is 140 mm.

Figure 10B:
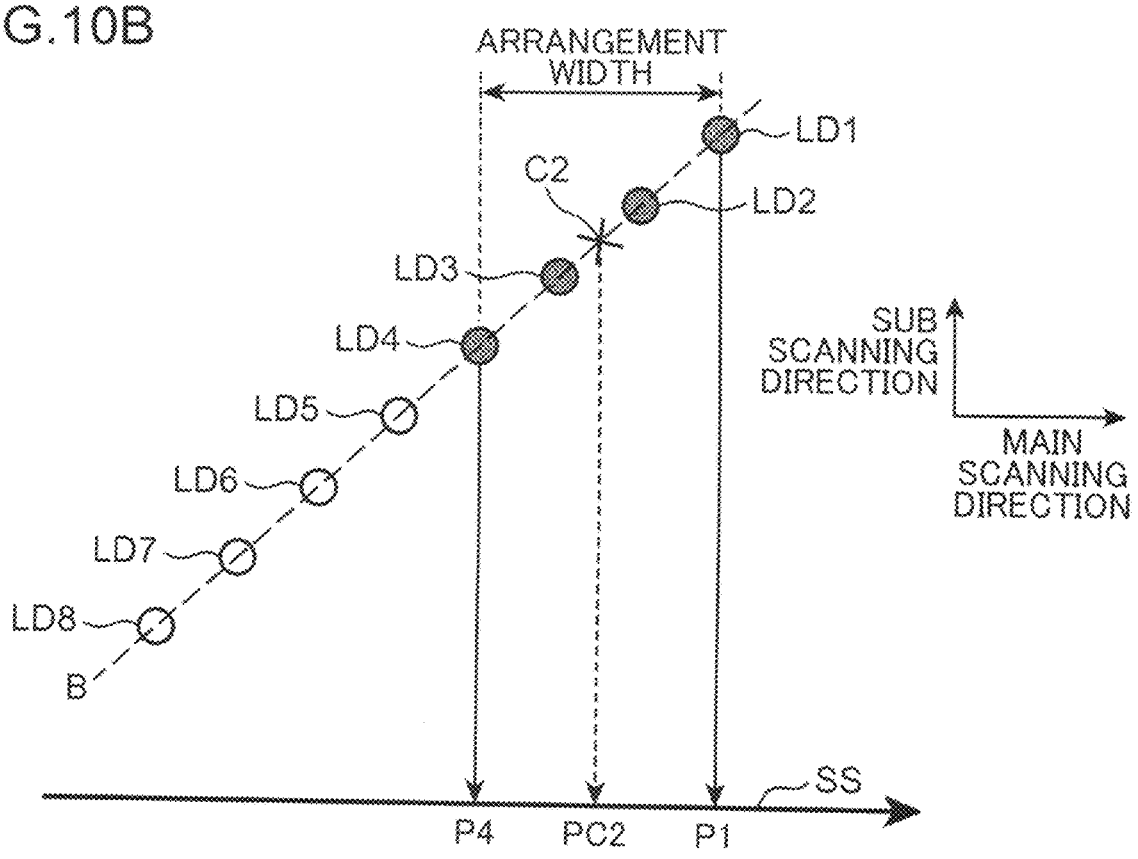
FIG. 10B is a schematic view showing an example where light quantity correction timing is changed when four LDs are used.

FIG. 10B is a schematic view for describing desired light quantity correction timing when four LDs formed of the LD1 to the LD4 are used. In FIG. 10B, the center point C2 of the arrangement width of the LD1 to the LD4 in the main scanning direction is shown. An error in concentration correction can be suppressed by performing the light quantity correction in conformity with the profile data shown in FIG. 7B using an imaginary main scanning position PC2 on the surface to be scanned SS which corresponds to the center point C2 as the reference. However, in this embodiment, the imaginary main scanning position PC1 is fixed and hence, the imaginary main scanning position PC1 cannot be moved to the imaginary main scanning position PC2. In view of the above, the light quantity setting part 28 modifies light quantity at the imaginary main scanning position PC1 as if an effect substantially equal to an effect acquired by shifting the imaginary main scanning position from the PC1 to the PC2 can be obtained.

[Modification of Correction Light Quantity]

Figure 13:
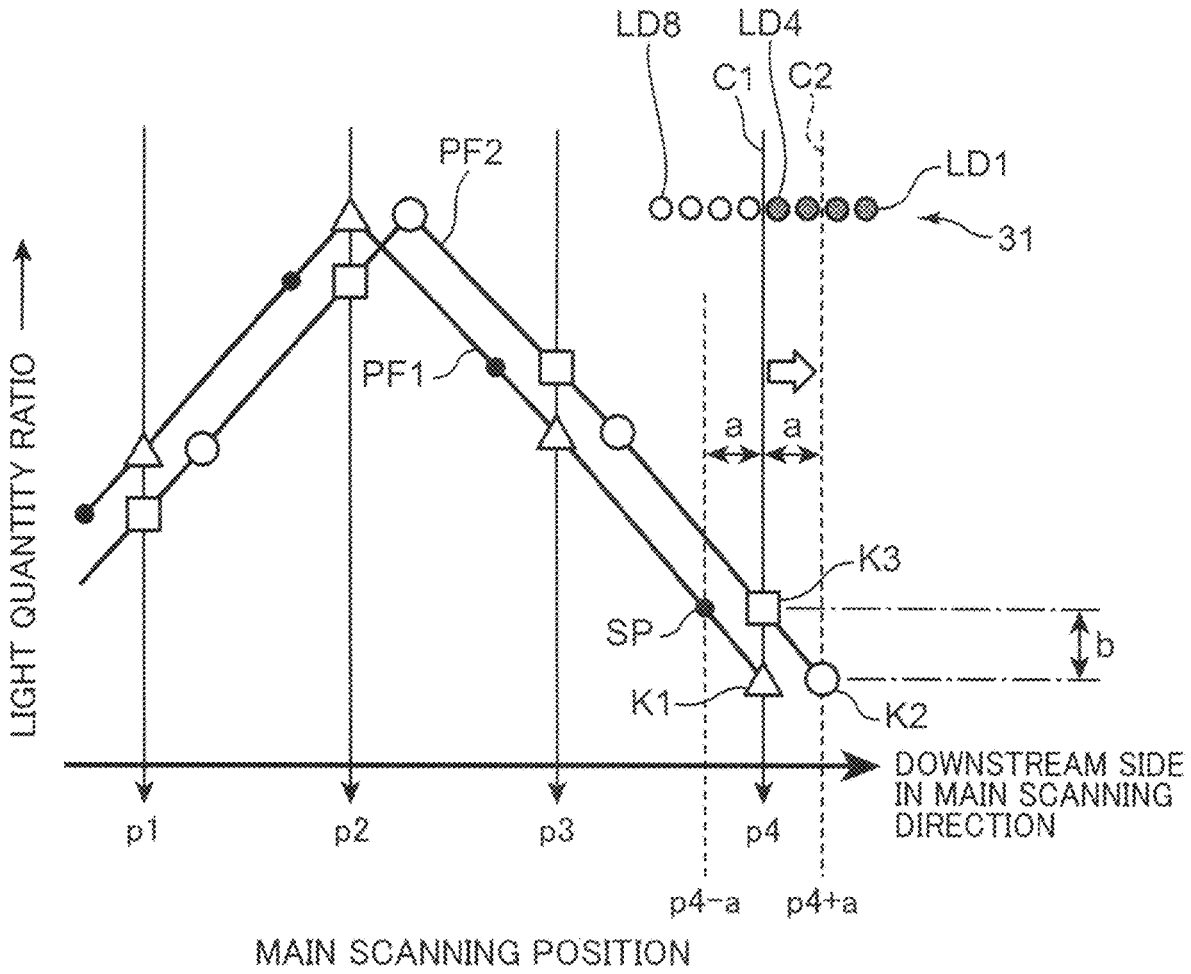
FIG. 13 is a schematic view for describing modification of a correction light quantity at a light quantity correction position according to this embodiment.

FIG. 13 is a schematic view for describing modification of a correction light quantity at a light quantity correction position according to this embodiment. In FIG. 13, p1, p2, p3 and p4 taken on an axis of abscissas are main scanning positions fixedly determined in advance as light quantity correction positions. In this processing, assume that the timing control part 26 performs light quantity correction of concentration irregularities on all LDs which the LD selection part 25 selects (all selected beams) based on light quantity correction profile PF1 (light quantity correction data) at the same point of time at timing where the center point C1 of the arrangement width of the LD1 to the LD8 which the multi beam light emitting portion 31 includes passes the respective positions formed of the light quantity correction positions p1 to p4.

When the LD selection part 25 selects all of the LD1 to the LD8, the center point C1 of the arrangement width of the LD1 to the LD8 (the previously mentioned imaginary main scanning position PC1) and the respective positions formed of the light quantity correction positions p1 to p4 agree with each other. In this case, the modification of the correction light quantity is unnecessary. Accordingly, for example, in the case where the light quantity setting part 28 sets a correction light quantity K1 in accordance with the light quantity correction profile PF1 at the light quantity correction position p4, and the LD driver 33 makes the LD1 to the LD8 emit light, scanning can be performed in a state where concentration irregularities are corrected with high accuracy.

On the other hand, when the LD selection part 25 selects only the LD1 to the LD4, the positional deviation occurs in the main scanning direction between the center point C2 of the arrangement width of the LD1 to the LD4 and the respective positions formed of the light quantity correction positions p1 to p4. In FIG. 13, the positional deviation in the main scanning direction between the center point C1 of the arrangement width of the LD1 to the LD8 and the center point C2 of the arrangement width of the LD1 to the LD4 is indicated as a distance a. In the case where such a state is left as it is, a correction light quantity K1 is given not at timing that the center point C2 passes the light quantity correction position p4 but after the LD1 to the LD4 pass the light quantity correction position p4 and hence, an error occurs in correction of concentration irregularities.

To prevent the occurrence of an error in correction of concentration irregularities, it is sufficient to modify the light quantity correction profile PF1 to the shift profile PF2 shifted toward a downstream side in the main scanning direction by the distance a such that a state is brought about where a correction light quantity K2 equal to the correction light quantity K1 is given at timing where the center point C2 passes the light quantity correction position p4+a. In performing such modification, a shift light quantity SP of the position shifted toward an upstream side in the main scanning direction by a deviation distance a (light quantity correction position p4-*a*) is obtained by performing an interpolation operation at the light quantity correction profile PF1.

Then, a correction light quantity K3 equal to the shift light quantity SP is supplied to the LD1 to the LD 4 at the light quantity correction position p4. That is, the correction light quantity K1 at the light quantity correction position p4 is modified to the correction light quantity K3 by adding a differential b between the correction light quantity K1 and the shift light quantity SP. Also at other light quantity correction positions p1, p2, p3, in the same manner, shift light quantity SP is obtained, and the correction light quantity is modified by adding or subtracting an amount corresponding to the shift light quantity SP. With such modification processing, it is possible to bring about a state which is substantially equal to a state where correction light quantity K2 is given at timing that the center point C2 passes the position p4+a, for example. That is, it is possible to acquire an advantageous effect that the light quantity correction profile PF1 is substantially modified to the shift profile PF2. In an actual control, the light quantity setting part 28 changes drive currents supplied to the LD1 to the LD4 by adding or subtracting a differential b corresponding to a shift light quantity SP at the light quantity correction positions p1 to p4.

FIG. 14 is a view in the form of a table showing a specific example where a light quantity correction profile PF1 (profile data) is modified to a shift profile PF2 (modified profile data). In FIG. 14, block numbers are numbers given at every 10 mm when the main scanning position (a height of an image) changes between −150 mm and 150 mm, and indicate the light quantity correction positions described above. A table on a left side of FIG. 14 shows a set example of correction light quantities at the respective block numbers (light quantity correction positions) in original profile data. A table on a right side of FIG. 14 shows modified correction light quantities at the respective block numbers (light quantity correction positions). In this table, the main scanning position of the center point C2 in the arrangement width of the LD1 to the LD4 is shown with respect to the respective scanning positions of the respective block numbers. In this case, an example where a position deviation distance a is 1 mm is exemplified. The light quantity setting part 28 sets light quantities of the LD1 to the LD4 by looking up the table shown in FIG. 14 or the like.

Figure 15A:
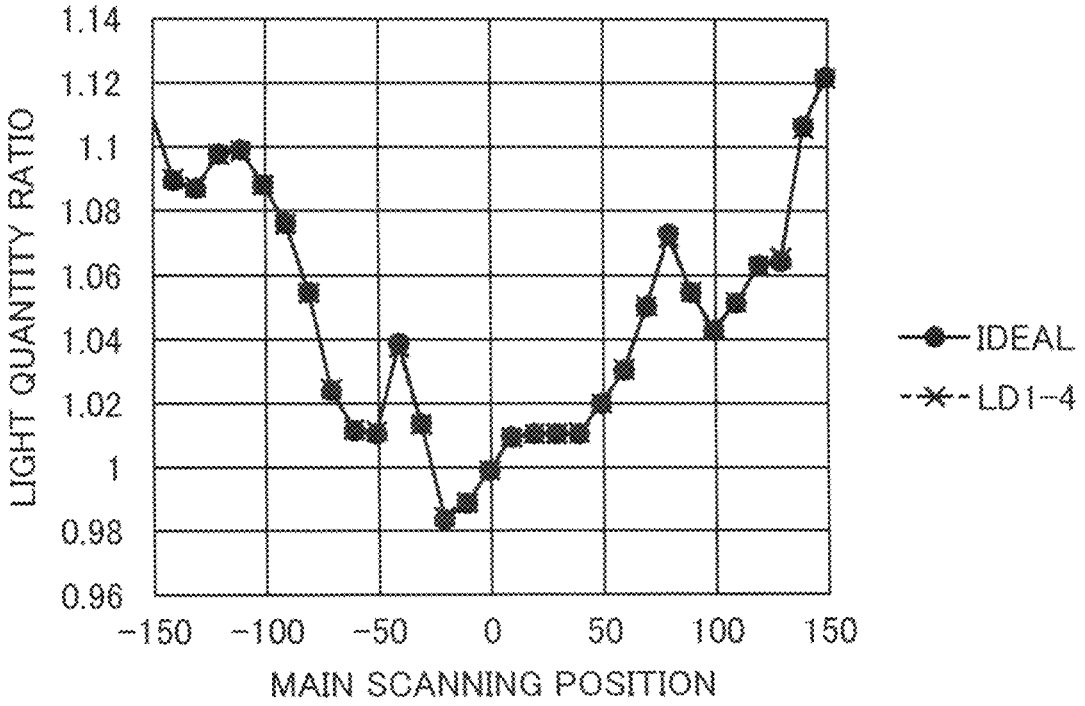
FIG. 15A is a graph showing deviation between ideal light quantity correction and an average light quantity correction value of four beams when light quantity correction modified by applying a shift light quantity is used.
Figure 15B:
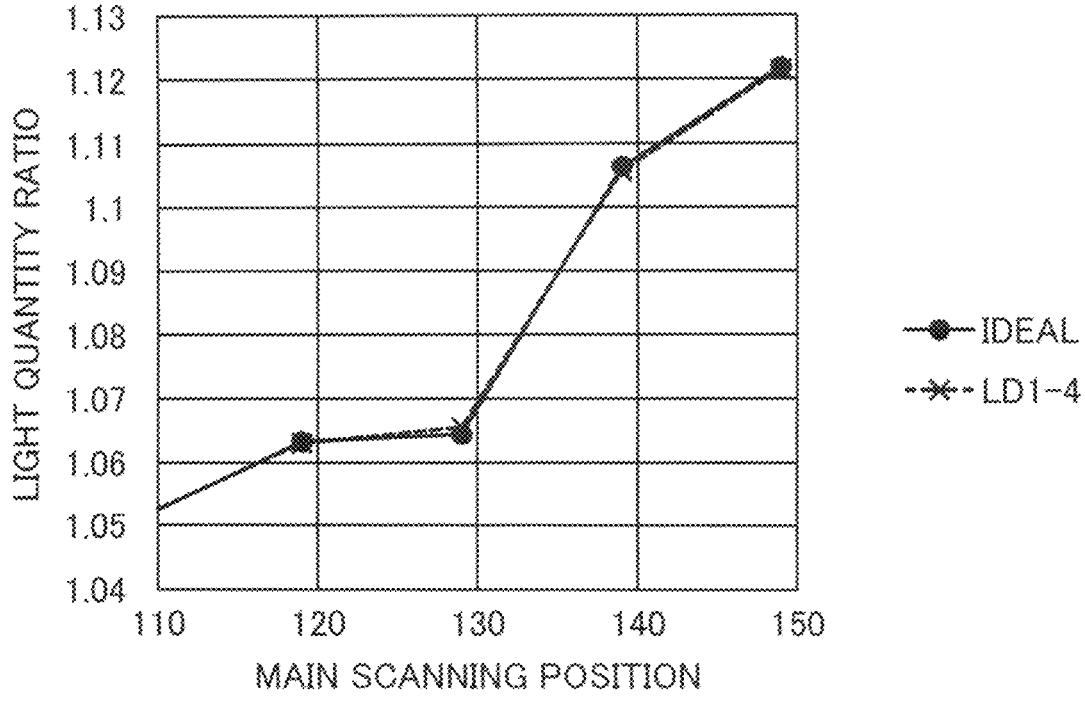
FIG. 15B is a graph showing a portion of FIG. 15A in an enlarged manner.

FIG. 15A is a graph showing a deviation between a profile of an ideal light quantity correction value (a profile shown in FIG. 7B) and an average light quantity correction value of four beams using the modified correction light quantities shown in FIG. 14. FIG. 15B is a graph showing a range where a height of an image is 110 to 150 mm in FIG. 15A. It is understood from these drawings that substantially no difference exists between the ideal profile and the profile of an average light quantity correction value of four beams due to the use of the shift light quantity SP described with reference to FIG. 13. That is, it is found that an error in the concentration correction is favorably suppressed.

[Manner of Operation and Advantageous Effects]

According to the image forming apparatus 1 (optical scanner 11) of this embodiment described heretofore, light quantities of the respective beams emitted from the LDs selected from the LD1 to the LD8 are corrected at the same correction timing based on the same concentration correction profile data at the respective positions in the main scanning direction. Accordingly, compared to a mode where light quantities of the beams of the individual LDs are corrected at different timings, a control can be simplified, and the increase of a scale of the circuit can be suppressed. Further, the respective positions at which a light quantity is changed in the main scanning direction are fixedly determined in advance as light quantity change positions. Such a configuration also contributes to the simplification of a control.

When the center region of the arrangement width in the main scanning direction of the selected beams which the LD selection part 25 selects is moved in the main scanning direction corresponding to a selected mode of the beams, for example, when the center point is moved from the center point C1 to the center point C2 due to a change of the selected beams from the LD1 to the LD8 to the LD1 to the LD4, correction light quantities at the light quantity correction positions p1 to p4 are modified corresponding to a shift light quantity SP. By shifting light quantity change timings of the respective beams in response to the movement of the center point from the center point C1 to the center point C2, an error in a change of light quantity between the beams existing within the arrangement width can be suppressed at a low level. However, when the light quantity change positions are fixedly determined in advance, shifting of light quantity change timings cannot be performed. Also in such a case, by applying the modified correction light quantity K3 obtained by adding or decreasing the shift light quantity SP at the light quantity correction positions p1 to p4, it is possible to form the shift profile PF2 as if the light quantity correction profile PF1 is displaced in the main scanning direction by an amount corresponding to the movement.

That is, in the light quantity correction profile PF1, the shift light quantity SP corresponds to a light quantity at the position shifted in the main scanning direction by an amount corresponding to the movement (distance a) from the center point C1 of the arrangement width to the center point C2 of the arrangement width. Accordingly, for example, a light quantity applied at the center point C2 after the center point C2 moves with respect to the light quantity correction position p4 by the distance a substantially becomes a correction light quantity K1 to be given at the light quantity correction position p4. Accordingly, even when the light quantity change position is fixed, it is possible to form a state substantially equal to a state where light quantity change timing is shifted. Accordingly, even when the number of beams to be used is changed, an error in a light quantity change can be maintained at a low level.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An optical scanner comprising:

a multi beam light source capable of generating a plurality of beams arranged in a main scanning direction;

a scanning optical system which scans a predetermined surface to be scanned in the main scanning direction by the plurality of beams; and a controller which controls turn-on operations and light quantities of the plurality of respective beams, wherein the controller specifies, from among the plurality of beams, selected beams for scanning, and the controller changes light quantities of the respective selected beams at the same change timing based on the same profile data at respective positions in the main scanning direction which are fixedly determined in advance as light quantity change positions, wherein when a position of a center region in an arrangement width of the plurality of selected beams in the main scanning direction is moved in the main scanning direction in response to a selected mode of the plurality of selected beams, in the profile data, the controller derives a shift light quantity at a position shifted in the main scanning direction by an amount corresponding to the movement of the position of the center region, and the light quantity is modified so that the shift light quantity is applied at the light quantity change position.

2. The optical scanner according to claim 1, wherein the profile data is light quantity correction data which includes a profile where respective positions in the main scanning direction and correction light quantities are associated with each other, the profile being obtained based on a concentration irregularities characteristic in the main scanning direction when the surface to be scanned is scanned by the scanning optical system, and the controller is configured to correct light quantities of the respective selected beams at the same change timing based on the light quantity correction data at the respective light quantity change positions, and the controller modifies correction light quantities at the respective light quantity change positions so that a shift light quantity at a position shifted corresponding to movement of a center region of the arrangement width in the main scanning direction is applied in the light quantity correction data.

3. The optical scanner according to claim 2, wherein the multi beam light source includes a plurality of light emitting elements which emit beams respectively, and a driver which supplies a drive current to the light emitting elements, the controller includes a light quantity setting part for supplying the drive current having an amplitude corresponding to the profile data to the driver, and the light quantity setting part changes the drive current corresponding to the shift light quantity.

4. The optical scanner according to claim 1, wherein the multi beam light source includes a plurality of light emitting elements which emit beams respectively, and a driver which supplies a drive current to the light emitting elements, the controller includes a light quantity setting part for supplying the drive current having an amplitude corresponding to the profile data to the driver, and the light quantity setting part changes the drive current corresponding to the shift light quantity.

5. The optical scanner according to claim 1, wherein the plurality of beams are arranged in a straight line shape, and the controller specifies all of the plurality of beams as the selected beams when a line speed of image forming processing is set to a normal line speed, and specifies an arrangement portion which forms a half of the plurality of beams arranged in a straight line shape as the selected beams when the line speed of the image forming processing is set to a ½ line speed.

6. The optical scanner according to claim 1, wherein the profile data is light quantity correction data for cancelling concentration irregularities in the main scanning direction.

7. An image forming apparatus comprising:

an image carrier which carries an electrostatic latent image; and the optical scanner according to claim 1 which radiates a light beam to a peripheral surface of the image carrier which forms the surface to be scanned.

* * * * *